United States Patent [19]

Herbein

[11] 4,099,389

[45] Jul. 11, 1978

[54] CIRCULAR KNITTING MACHINE

[75] Inventor: Herbert H. Herbein, Reiffton, Pa.

[73] Assignee: Ripple Twist Mills, Inc., Reading, Pa.

[21] Appl. No.: 706,529

[22] Filed: Jul. 19, 1976

[51] Int. Cl.[2] ..... D04B 9/16; D04B 15/50

[52] U.S. Cl. ..... 66/9 R; 66/132 R; 66/135

[58] Field of Search ..... 66/9 R, 10, 135, 132 R

[56] References Cited

U.S. PATENT DOCUMENTS

| | | | |
|---|---|---|---|
| 188,644 | 3/1877 | Landenberger | 66/135 X |
| 1,166,434 | 1/1916 | Claringburn | 66/9 R |
| 1,198,275 | 9/1916 | Rick et al. | 66/135 |
| 1,530,992 | 3/1925 | Foster | 66/9 R |
| 1,531,246 | 3/1925 | Price | 66/9 R |
| 1,880,304 | 10/1932 | Walton | 66/9 R |
| 1,891,204 | 12/1932 | Getaz | 66/135 |
| 3,124,944 | 3/1964 | Bond et al. | 66/9 R |
| 3,342,043 | 9/1967 | Shannon | 66/111 |
| 3,592,024 | 7/1971 | Levin | 66/9 R |

FOREIGN PATENT DOCUMENTS

| | | | |
|---|---|---|---|
| 239,261 | 8/1925 | United Kingdom | 66/10 |
| 730,188 | 5/1955 | United Kingdom | 66/135 |

*Primary Examiner*—Wm. Carter Reynolds
*Attorney, Agent, or Firm*—Fay & Sharpe

[57] ABSTRACT

A circular knitting machine having means to knit a plurality of circumferentially spaced warp wales incorporating an elastic weft yarn in a helical manner in the knit chain stitches of the individual warp wales. Each of the warp yarns is fed to a respective needle by means of a rotating feed tube. A single rotation of a feed tube causes a single portion of warp yarn to be engaged by its respective needle.

1 Claim, 6 Drawing Figures

FIG. 5
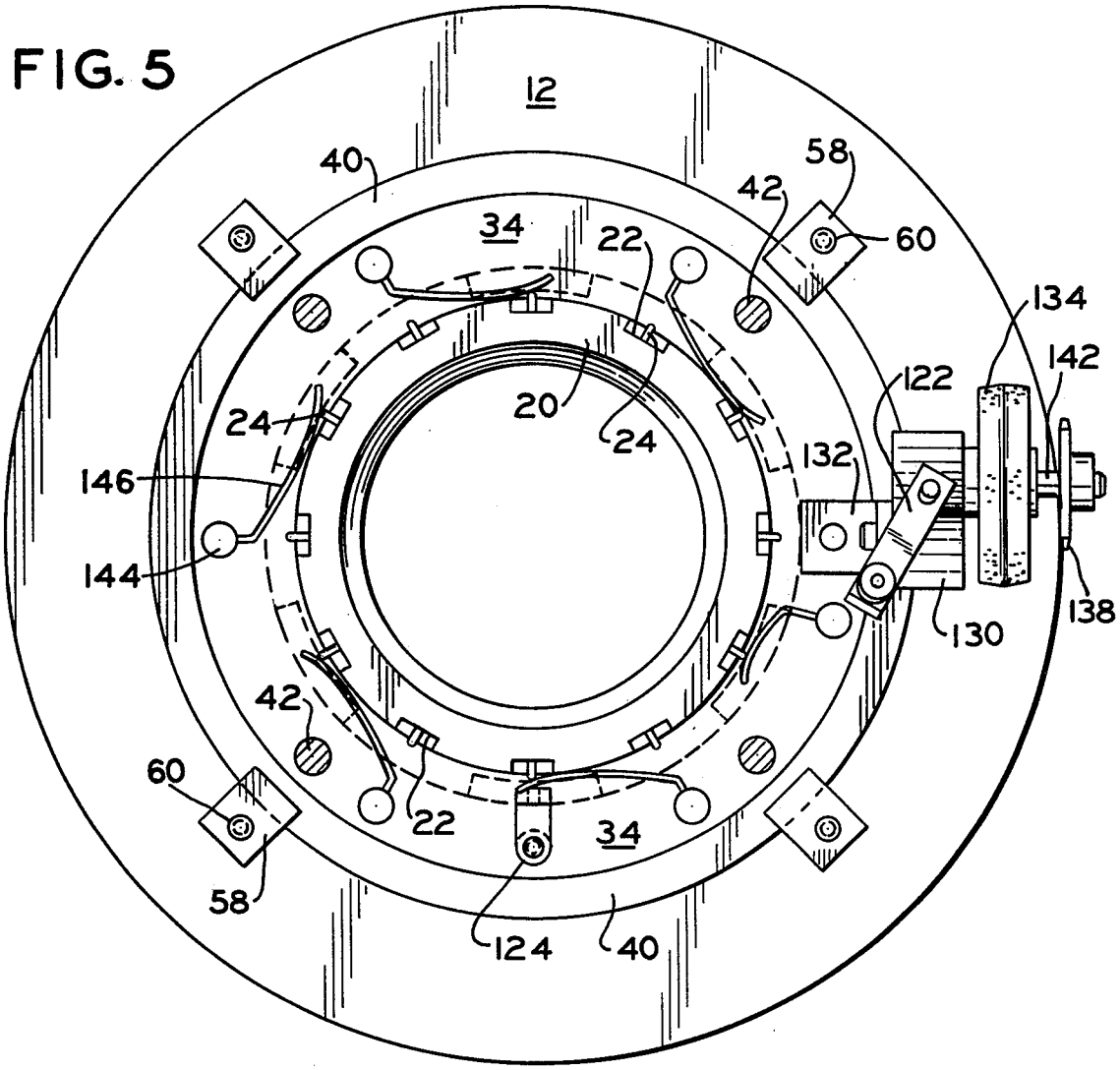
FIG. 6
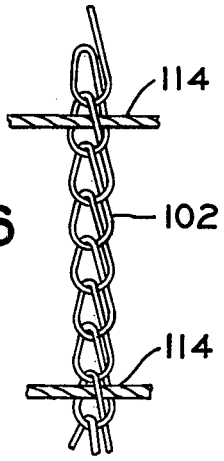
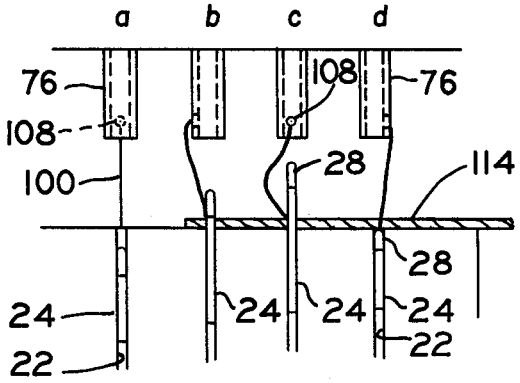
FIG. 2

CIRCULAR KNITTING MACHINE

BACKGROUND OF THE INVENTION

This invention relates to a circular knitting machine for producing tubular elastic netting. Netting of this type has many uses. The preferred embodiment of applicant's invention is used, however, for knitting netting for processing meat such as rump roast, fresh hams and the like. Tubular or circular netting of the type used for the processing of meat products is generally characterized by a plurality of circumferentially spaced warp wales knit from a cotton yarn interconnected by a generally helically disposed elastic weft yarn which is incorporated unknit in spaced chain stitches of the warp wales.

Machines for producing tubular elastic netting of the type just described have been known to the industry for some time. Two such machines which are known to applicant are shown and described in U.S. Pat. No. 3,513,668 to Marcus Mintz and 3,592,024 to Nathan Levin.

Both of the knitting machines shown and described in the Mintz (U.S. Pat. No. 3,513,668) and Levin (U.S. Pat. No. 3,592,024) patents incorporate pivotal warp feed mechanisms which oscillate in a back and forth motion in order to feed a warp yarn to a respective needle. In the patent to Mintz (U.S. Pat. No. 3,513,668) the pivotal warp guides 30 swing from left to right as viewed in FIGS. *7a* and *7b*. In doing so the warp yarn follows the path indicated in the dotted line of FIG. *7a* across the needle and under the hook. As the needle of Mintz is then lowered the warp yarn is drawn down into the needle groove where a warp stitch is made. At this time the cam 34 of Mintz rotates out of engagement with the warp guide 30. The guide 30 is then drawn by the tension in the warp yarn back to its initial position as shown in FIG. *7a* prior to making another stitch.

The warp yarn feed mechanism as shown in Levin (U.S. Pat. No. 3,592,024) is quite similar to the Mintz (U.S. Pat. 3,513,668) structure described above. In Levin the warp yarn is fed to its associated needle by means of a generally L-shaped yarn finger 37. The L-shaped yarn finger of Levin is adapted to move in a generally back and forth motion from a first position to a second position under the influence of a plurality of cams 21*a*, 21*b*, 21*c*, 21*d* (FIG. 2). As a respective cam moves out of engagement with a L-shaped yarn finger such finger returns to its initial position under the influence of a compression spring 39 (FIG. 6).

Applicant has found that there are a number of shortcomings in the operation of the circular knitting machines of the Mintz and Levin designs.

As an example, applicant has found that the spring return mechanism which is required to be associated with each of the L-shaped yarn fingers of the Levin structure is subject to failure from time to time. When a spring fails in a circular knitting machine structure of the type shown in the Levin patent it is necessary to stop the entire machine and replace the spring. The resultant down time not only interrupts production but also necessitates the availability of skilled operators who can attend to the machine at such time as there is a breakdown.

A further disadvantage of the yarn feed machanisms of the type shown in the Mintz or Levin patents discussed above is the fact that the oscillatory or back and forth motion of the yarn feed fingers or guides places a restriction on the number of chain stitches that may be placed in a warp wale with a single rotation of the cam mechanism.

Referring, for example, to FIG. 2 of the Levin U.S. Pat. No. 3,592,024 it will be noted that there are shown and described a total of four cams 21*a*, 21*b*, 21*c* and 21*d* adapted to rotate about the 20 yarn feed fingers 37. The four cams shown in FIG. 2 of Levin will produce a total of four chain stitches in each warp wale with one complete rotation of the cam mechanism. That is to say, as the four cams shown in FIG. 2 of Levin make a complete rotation about the yarn fingers, each finger will be indexed four times thus to produce a total of four chain stitches in the warp wale associated with each of the fingers. Since the elastic weft wale 17 of Levin rotates with the cams 21*a*–21*d*, the apparatus of FIG. 2 of Levin will produce tubular knitting of the type shown in FIG. 7 of Levin with the elastic weft yarn incorporated into the warp wales at every fourth chain stitch. Should it be desired to increase the number of chain stitches in the warp wales between parallel portions of the weft yarn it is necessary to increase the number of cams in the mechanism shown in FIG. 2 of Levin to the number of chain stitches desired. For example, if it is desired to provide that the elastic weft yarn should be incorporated into every six chain stitches of a warp wale, it is necessary to provide for six rotating cams in the mechanism shown in FIG. 2 of Levin in order to index each of the yarn fingers six times during a complete rotation of the cams and weft yarn. Providing extra cams may not be possible, however.

Since the structure shown in FIG. 2 of Levin requires that a certain amount of return time be allowed in order to permit each L-shaped yarn finger to move from its cammed position to its free position, there is a practical limit to the number of cams that can be employed in the Levin structure. If an excessive number of cams are utilized it is not possible for a single yarn finger to complete its oscillation or indexing from its free position to its cammed position (and return) before being indexed by a succeeding cam.

Applicant's improved circular knitting machine eliminates the oscillatory or back and forth motion of the yarn fingers or yarn guides as shown in the Levin and Mintz patents. Rather applicant has incorporated in his circular knitting machine a continuously rotating hollow feed tube which is driven not by cams but rather by an internal ring gear. Applicant has eliminated the necessity of providing spring returns for the yarn feed mechanism thus eliminating the objectionable maintenance problem associated with the repair or replacement of broken springs. In eliminating the oscillation of the ayrn feed mechanism applicant has increased the flexibility of circular knitting machines by making it possible to provide more chain stitches in the warp wale between adjacent portions of the elastic weft yarn.

BRIEF DESCRIPTION OF THE INVENTION

Briefly described, this invention is directed to an improved circular knitting machine having means to knit a plurality of circumferentially spaced chain stitched warp wales incorporating an elastic weft yarn in an unknit condition in spaced apart chain stitches of adjacent warp wales, the elastic weft yarn being helically captured by the warp wales.

Applicant's improved circular knitting machine incorporates a warp yarn feed mechanism in the machine head defined by a plurality of hollow rotatable feed tubes supported above a stationary slotted needle cylinder. Each of the rotatable feed tubes is provided with an aperture extending laterally therethrough. The warp yarns are threaded through the respective feed tubes and out of the respective apertures. The feed tubes are rotated by an internal ring gear and pinion drive mechanism which is driven by the cam ring operating the needles of the needle cylinder. Means are provided to feed an elastic weft yarn across the warp yarns as the warp yarns are fed to respective needles once during each rotation of the feed tubes.

BRIEF DESCRIPTION OF THE DRAWINGS

A more complete description of the invention will now be made with reference to the accompanying drawings in which:

FIG. 2 is a schematic view showing the operation of a feed tube and latch needle of the invention at such time as a warp yarn is fed to the needle;

FIG. 5 is an elevational view, partly in phantom, taken along the line 5—5 of FIG. 1;

FIG. 6 is a schematic view of a warp wale and an elastic weft yarn incorporated in the open chain stitches of the warp wale of tubular netting knit by the machine of this invention.

DESCRIPTION OF THE PREFERRED EMBODIMENT

Figure 1:
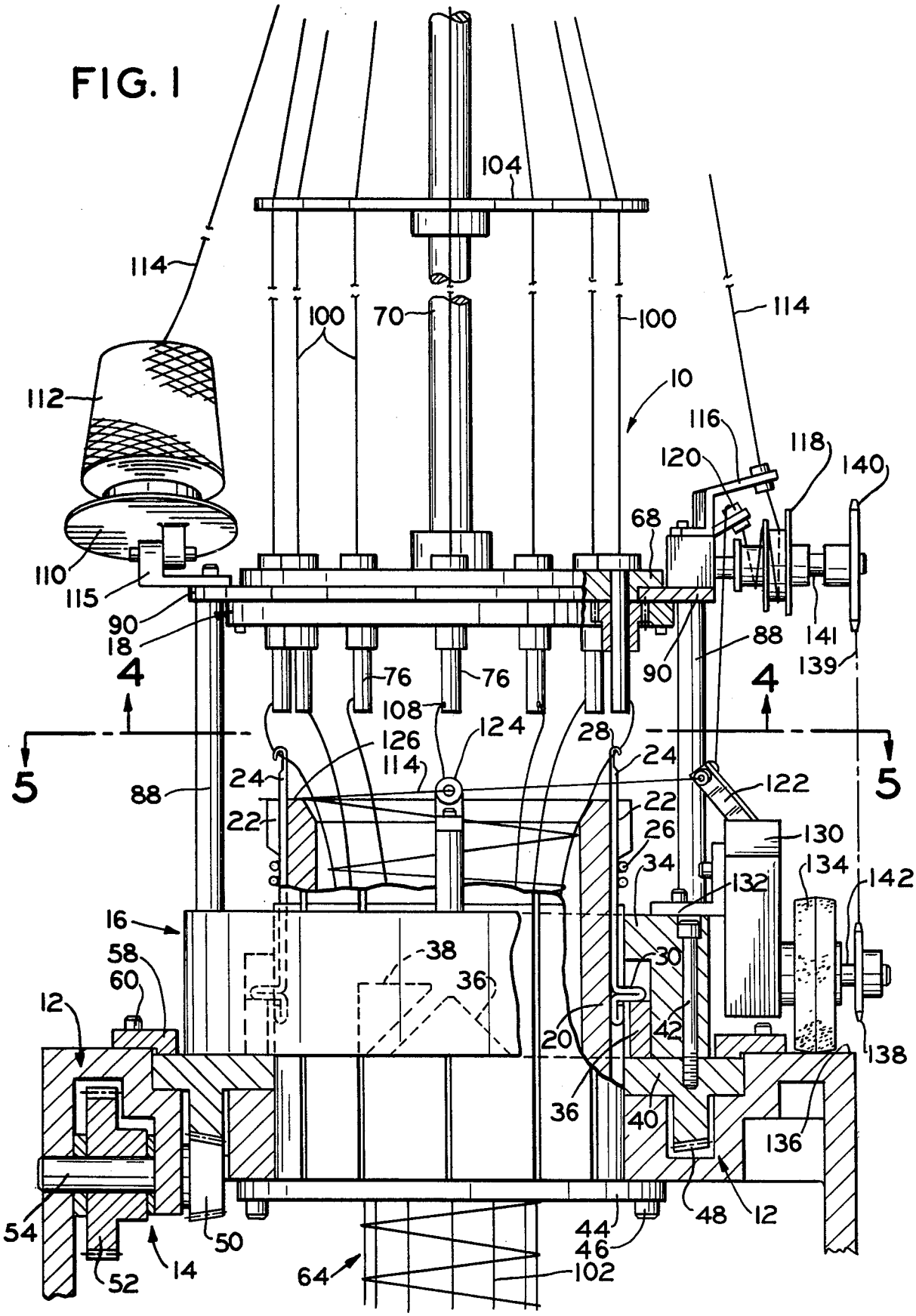
FIG. 1 is a front elevational view, partly in section, of a circular knitting machine incorporating the improvements of this invention.

Turning now to FIG. 1, the improved circular knitting machine of this invention is generally designated 10 and includes as basic elements thereof a base 12, drive means 14, slotted needle cylinder assembly 16, and a yarn feed mechanism 18.

Needle Cylinder Assembly

Attention will first be directed to the slotted needle cylinder assembly designated generally 16 in FIG. 1. This assembly includes, as components thereof, a stationary hollow cylinder 20 having a plurality of longitudinally extending slots 22 in the external surface thereof. Each of the slots 22 is adapted to receive a latch needle 24. The needles are retained in place by means of garter springs 26. As will be noted in FIG. 1 springs 26 are received in a cutout or relieved portion of the exterior wall of cylinder 20 so as to be in direct engagement with the needles 24 retaining such needles in place.

The latch needles 24 are each characterized by a hook 28 and a cam follower 30. Omitted from FIG. 1, in the interest of clarity, is the latch normally associated with the hook 28 of the needle. Since latch type needles are well known to those skilled in the art it is not believed necessary to show the latch in FIG. 1.

An annular cam ring 34 surrounds the cylinder 20 and includes, at internal portions thereof, a plurality of sets of needle operating cams 36, 38. It will be appreciated from an inspection of FIG. 1 that needle operating cam 36 provides for a lifting or raising of the latch needle 24 in the slotted cylinder assembly whereas the associated cam 38 provides for a lowering of the latch needle. Lifting and lowering of the needle occurs, therefore, as a consequence of rotation of the cam ring 34.

Cam ring 34 is, in turn, secured to rotary drive ring 40 by means of a plurality of fasteners 42. Rotary drive ring 40 is supported by base 12. Similarly, it will be noted that the cylinder 20 is supported by base 12 by means of a securing flange 44 and fasteners 46.

The rotary drive ring 40 is received within complementary seating walls of base 12 so that the ring 40 may rotate relative to the base as will be appreciated from FIG. 1. A plurality of hold-down lugs 58 are secured to base 12 by means of fasteners 60 in order to provide for rotatable retention of the drive ring within the base.

The rotary drive ring 40 is provided with a plurality of gear teeth 48 which are adapted to be engaged by pinion 50 supported by base 12. Pinion 50, it will be observed, is rotated upon the application of a driving force to spur gear 52 which is interconnected to the pinion by means of shaft 54.

To review the description of the needle cylinder assembly thus far the application of a driving torque to the spur gear 52 causes rotation of the pinion 50, the rotary drive ring 40, annular cam ring 34 and the associated sets or pairs of needle operating cams 36, 38. In turn, the latch needles 24 are caused to move or reciprocate in an up and down motion in the slots 22 of cylinder 20.

It can be appreciated from a study of FIG. 1 that the total number of reciprocating movements of the latch needles 24 during a single rotation of the annular cam ring 34 will vary depending upon the number of sets or pairs of needle operating cams 36, 38 defined internally of the annular cam ring. In the preferred embodiment of the invention as shown in FIGS. 1–5, a total of six sets or pairs of needle operating cams 36, 38 are provided in order to produce six up and down movements of the latch needles 24 with one complete rotation of the annular cam ring 34.

The slotted needle assembly generally designated 16 in FIG. 1 has been known to the industry for some time. Applicant does not assert that he has made an improvement in the needle cylinder assembly per se except insofar as such needle assembly cooperates with the improved yarn feed mechanism 18 to be described below.

As will be observed in FIG. 1 the slotted needle cylinder assembly is hollow thus making it possible to permit the tubular knitted fabric 64 (produced by the machine) to be drawn through the cylinder assembly 16 and thereafter taken up for packaging and shipment.

YARN FEED MECHANISM

Attention will now be directed to the yarn feed mechanism of this invention designated generally 18 in FIG. 1.

Figure 3:
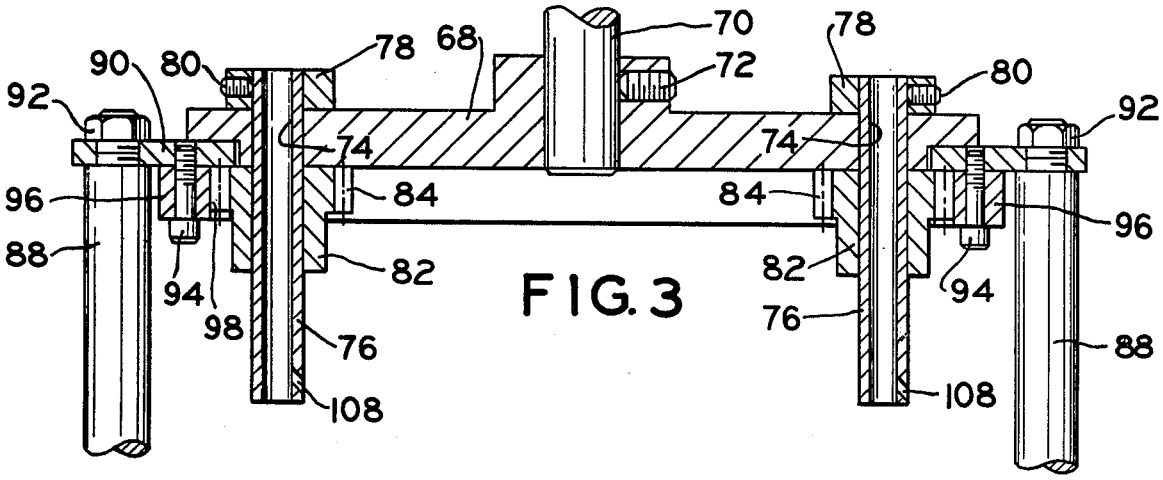
FIG. 3 is a cross-sectional view taken along the line 3—3 of FIG. 4.

A stationary feed tube support plate 68 is supported by a vertical stationary shaft 70 by means of a set screw 72 (FIG. 3). While not shown in FIG. 1 it should be appreciated that vertical shaft 70 is itself supported by the machine base 12 in order that the feed tube support plate 68 may be fixed in space in a position axially aligned with and disposed above the slotted needle cylinder assembly 16.

As will be observed in FIG. 3 the feed tube support plate 68 is provided with a plurality of apertures 74 which are adapted to receive a plurality of hollow rotatable feed tubes 76. Each feed tube 76 has associated with one end thereof a collar 78 which is secured to the feed tube by means of a set screw 80. There is likewise provided for each of the feed tubes a small gear or pinion 82 having external teeth 84. The pinion 82 is secured to the external surface of the feed tube 76 by means of a set screw (not shown in FIG. 3) or other appropriate attachment means well known to those skilled in the art. At the lowermost end of the feed tube there is provided an aperture 108 extending substantially laterally through the wall of the feed tube.

It should thus be understood that each of the feed tubes 76 of the yarn feed mechanism 18 is rotatably supported by the feed tube support plate 68. The support plate 68 is, in turn, made secure and stationary by means of shaft 70.

The drive means for rotating the feed tubes 76 emanates from the slotted needle cylinder assembly 16 and thus it will be necessary to refer to FIG. 1 for a more complete understanding of the relationship of the slotted needle cylinder assembly and the yarn feed mechanism. As will be observed in FIG. 1 a plurality of posts 88 are secured to the annular cam ring 34 and extend upwardly therefrom. While not shown in FIG. 1 it should be appreciated that the posts 88 are screw threadedly received in the annular cam ring 34 such that circular rotation of the annular cam ring 34 will produce circular rotation of the posts 88.

The upper portions of the posts 88 are attached to an annular ring 90 by means of nuts 92 (FIG. 3). Secured to the under surface of the annular ring 90 by means of fasteners 94 is an internal ring gear 96 having teeth 98 which are adapted to cooperate with and engage teeth 84 of the pinions secured to each of the feed tubes.

Figure 4:
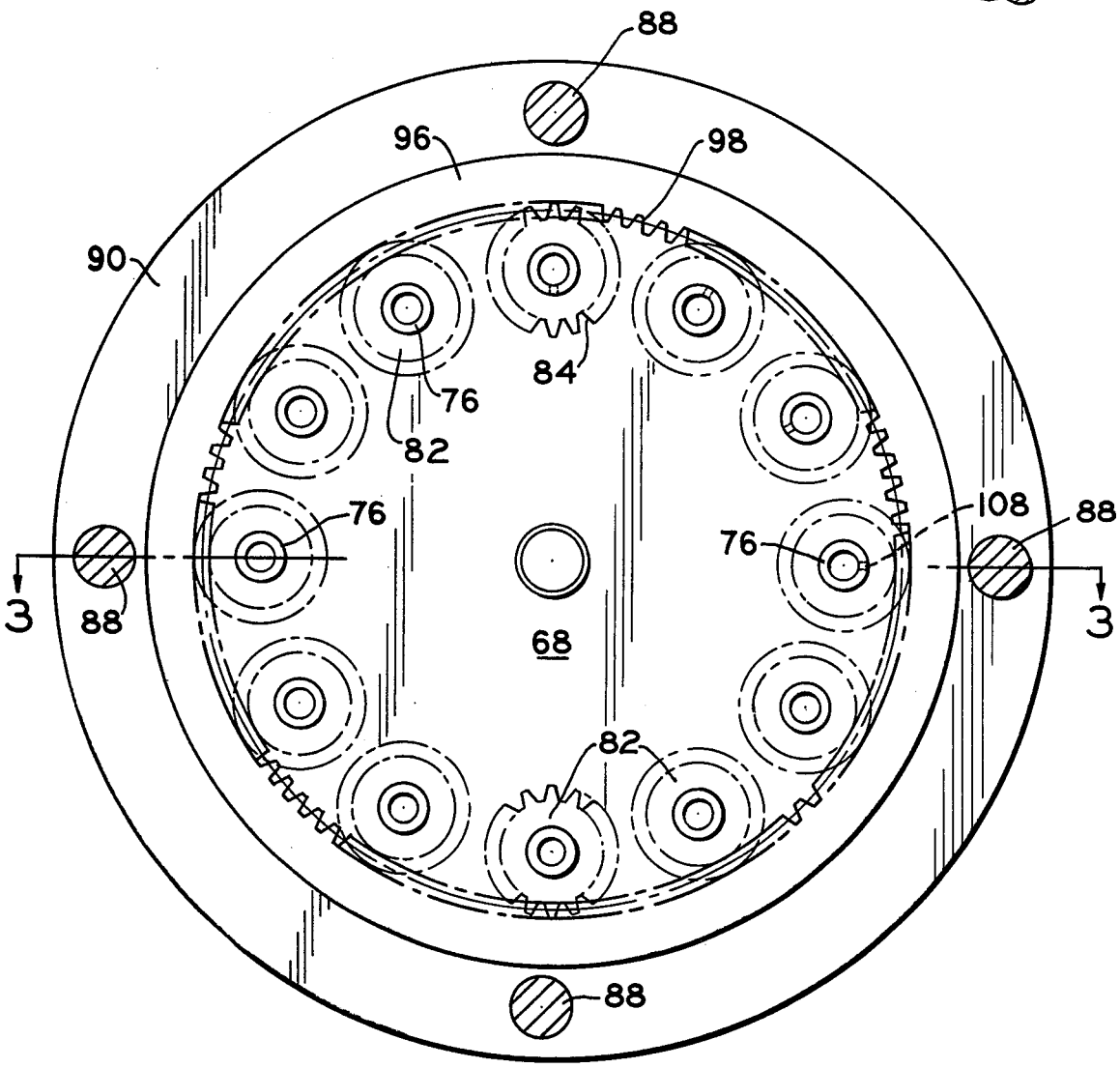
FIG. 4 is an elevational view, partly in section and partly in phantom, taken along the line 4—4 of FIG. 1.

The relationship of the internal ring gear 96 to the pinions 82 associated with each of the feed tubes 76 may be more clearly seen in FIG. 4. It should thus be appreciated that rotation of the internal ring gear 96 produces rotation of the plurality of pinions 82 thus producing rotation of each of the respective feed tubes 76.

In the preferred embodiment of the invention as shown in FIG. 4 the internal ring gear 96 is provided with 126 teeth whereas each of the pinions 82 is provided with 21 teeth. There is thus established a 6 to 1 ratio between the ring gear and the pinions resulting in six rotations of the pinions for each rotation of the ring gear.

As will be described more fully below, the preferred embodiment of the invention as shown in FIG. 4 will provide for the placement of a total of six chain stitches in each warp wale for each complete rotation of the internal ring gear 96. The 6 to 1 ratio established between the ring gear and the pinions thus corresponds to the six sets or pairs of needle operating cams 36, 38 provided in the slotted needle cylinder assembly 16. Thus a single rotation of the annular cam ring 34 will cause each of the latch needles 24 to be rasied and lowered six times. Correspondingly, a single rotation of the annular ring 90 (and the associated internal ring gear 96) will cause each of the feed tubes 76 to rotate six times. The number of rotations of the feed tubes is equal to the number of reciprocating movements of the latch needles. There is thus established a cooperation between the yarn feed mechanism 18 and the slotted needle cylinder assembly 16 which will be described in greater detail below.

It should further be appreciated from a study of the preferred embodiment of FIG. 4 that a total of 12 feed tubes are supported by the feed tube support plate 68. The preferred embodiment will, therefore, accommodate a total of 12 warp yarns 100 in the manner shown in FIG. 1. Since each feed tube is associated with a respective needle in the slotted needle cylinder assembly 16 the preferred embodiment of FIG. 1 includes a total of 12 latch needles 24. The tubular knitted product 64 (FIG. 1) will, therefore, include a total of 12 warp wales 102.

It should be made clear that while in the preferred embodiment of FIGS. 1–5 a 6 to 1 gear ratio is shown in the yarn feed mechanism 18 (and six pairs of cams are described in connection with the operation of the slotted needle cylinder assembly 16) it should be appreciated that other gear ratios and other numbers of sets of cams in the needle cylinder assembly may be used. Similarly, it should be emphasized that while 12 feed tubes are shown in the preferred embodiment it is possible to provide for as many as 28 feed tubes (or more) in a single yarn feed mechanism in order to increase the number of warp wales in the tubular knitted fabric. The number of feed tubes (and warp wales) is obviously dictated by the size of the netting.

Turning back to FIG. 1 it will be noted that the warp yarns 100 coming from their source (not shown) preferably pass through suitable circularly arranged apertures in a yarn ring 104 which is attached to the shaft 70. From the yarn ring 104 the respective warp yarns then pass into each of their associated feed tubes 76. The yarns are then threaded through apertures 108 (FIG. 3) extending substantially laterally through each of the feed tubes.

Generally speaking when the warp yarns 100 pass through the feed tubes 76 they are approximately coincident with the center lines or axes of the feed tubes. When, however, the yarns exit the feed tubes through the apertures 108 they are diverted from the center line of the feed tubes. Rotation of the feed tubes then causes the portions of the warp yarns (which extend from each of the respective feed tubes) to be rotated in a relatively wide loop defining a surface of revolution in order to be captured by the hooks 28 of the latch needles 24. That is to say, the needles intersect the surfaces of revolution of the warp yarns in order to receive the warp yarns as will be described more fully below.

Attention will now be directed to FIG. 1 wherein a weft bobbin holder 110 is shown holding a bobbin 112 of elastic weft yarn 114. The bobbin holder 110 is supported by means of bracket 115 which is rigidly secured to the annular ring 90 and post 88. The elastic weft yarn is threaded from the bobbin 112 through a guide 116 and around a feed take-up wheel 118. Thereafter the weft yarn 114 is threaded through guides 120, 122 and 124 before being deposited on the upper surface 126 of cylinder 20 radially inwardly of the latch needles 24 as will be described more fully below.

It should be appreciated that the weft bobbin 112, feed take-up wheel 118 and the guides 116, 120, rotate with the annular ring 90 (being driven by the rotating posts 88 extending from the cam 34). It should further be appreciated that the guides 122, 124 also rotate with the cam ring 34 being connected thereto. Guide 122, it will be noted from FIG. 1, is secured to support element 130 which, in turn, is secured to annular cam ring 34 by means of bracket 132. Guide 124 is secured directly to the upper surface of cam ring 34.

An idler wheel 134 is rotatably journalled to support element 130 and, as shown in FIG. 1, is adapted to rotate on the surface 136 of base 12 as cam ring 34 rotates. A sprocket 138 is secured to idler wheel 134 and is adapted to turn with idler wheel 134. A chain (shown schematically at 139) interconnects sprocket 138 with sprocket 140. Sprocket 140 is, in turn, attached to the feed take-up wheel 118 by means of extension 141. In the interest of clarity the chain is shown schematically in FIG. 1. It should be appreciated that the chain mechanism provides a direct means of translating rotation of idler wheel 134 and driving sprocket 138 to the driven sprocket 140 in order to activate the elastic weft yarn feed mechanism as will be described below.

OPERATION

As a drive input is provided at the drive means 14 the rotary drive ring 40 is caused to rotate along with the associated annular cam ring 34. In turn, rotation of the annular cam ring 34 causes rotation of the respective pairs of needle operating cams 36, 38 causing the needles 24 to rise and fall. Rotation of the annular cam ring 34 also causes rotation of the posts 88 and the annular ring 90. All elements associated with annular ring 90 thus rotate including the internal ring gear 96, pinions 82, feed tubes 76, the elastic weft yarn bobbin 112 and the weft yarn feed mechanism which includes the feed take-up wheel 118.

The details of the knitting operation, which is brought about by providing for proper placement and orientation of the needle operating cams and the feed tubes, are shown schematically in FIG. 2. In sequence *a* of FIG. 2, the latch needle 24 is shown in a lowered position and the feed tube 76 has rotated to a point where the aperture 108 (shown in phatom in sequence *a* of FIG. 2) is not in sight. The elastic weft yarn 114 is shown in FIG. 2 as being fed along the upper surface of the needle cylinder (surface 126 of FIG. 1) so that it lies radially outwardly of the warp yarn 100 but in a position radially inwardly of or behind the latch needle 24. Turning to sequence *b* of the schematic of FIG. 2 it will be noted that as the latch needle 24 rises the feed tube 76 is continuing to rotate with the aperture 108 thereof just coming into view. In sequence *c* of FIG. 2 the aperture 108 of the feed tube is now visible and the warp yarn 100 is defining somewhat of a loop (rotation of which defines a surface of revolution) that will cause it to pass across the latch needle 24 and under the hook 28 and, at the same time, to pass over the weft yarn 114. Finally in sequence *d* of FIG. 2, the hook 28 of the latch needle 24 has captured the warp yarn 100 and has been lowered into the needle groove over the weft yarn 114 thus completing a stitch. The warp stitch is repeated as the feed tube 76 makes another complete rotation and the needle 24 is raised. However, in the preferred embodiment as shown in FIGS. 1–5, five warp stitches will be made before the elastic weft yarn is again introduced to the same needle. This is due to the fact that there are six rotations of the feed tube (and six indexing motions of the latch needles 24) for each rotation of the weft yarn feed mechanism.

To repeat, the placement of six pairs of cams 36, 38 in the slotted needle cylinder assembly and the provision of a 6 to 1 gear ratio in the yarn feed mechanism causes six warp stitches to be made in a warp wale for each rotation of the annular cam ring 34. The elastic weft yarn, however, is introduced to each needle only once during each rotation of the annular cam ring. Thus the resulting knitted tubular fabric has the appearance shown in FIG. 6 wherein successive weft yarn portions 114 are shown incorporated into every sixth chain stitch of the warp wale 102.

As will be also apparent from a study of FIG. 6 the weft yarn 114 is not actually knitted into the chain stitches of the warp wale 102. Rather the weft yarn 114 is incorporated, unknit, in the spaced chain stitches of the warp wale. This is due to the fact that the weft yarn is passed behind or radially inwardly of the latch needles 24 as shown schematically in FIG. 2. If it is desired to produce an interlocking stitch with the warp and weft yarns, this may be accomplished by passing the weft yarn 114 in front of or radially outwardly of the latch needles so that the needle also engages the weft yarn (on downward movement) and draws the two ends together into the needle groove.

Positive feed of elastic weft yarn to the needle cylinder is provided by means of the feed take-up wheel 118 driven by the chain engaged sprockets 138, 140 and with power being supplied by the idler wheel 134 as it rotates with annular cam 34 along surface 136 of base 12. The amount of feed of weft yarn 114 to the needle cylinder may be varied by adjusting the radial position of the idler wheel 134 relative to the center line of the slotted needle cylinder assembly. Should it be desired to increase the rate of feed of weft yarn to the slotted needle cylinder assembly it is merely necessary to move idler wheel 134 radially outwardly on its shaft 142 (FIG. 1) so as to increase the circumference of rotation of the idler wheel 134 and, therefore, its speed. Increased speed of the idler wheel 134 increases the rotation of the sprockets 138, 140 and, consequently, the rotation of the take-up wheel 118.

Mounted on the upper surface of the annular cam ring 34 as shown in FIG. 5 are a plurality of upstanding post members 144 each with a wire guide 146 extending therefrom. In the interest of clarity these elements have been omitted from FIG. 1. The function of the wire guides 146 is to obstruct the latches of the latch needles 24 to prevent premature closure thereof when the latch needles are in a raised position. That is to say, when latch needles 24 have reached a fully raised position in order to receive the warp yarn the premature closing of the needle latch could cause the needle to miss a stitch. Accordingly, the wire guides 146 (FIG. 5) are provided to obstruct the latches of the needle and prevent the premature closing thereof when the needles are in a raised position. As will be noted in FIG. 5 the ends of the wire guides 146 are in alignment with the needles 24 when the lifting cams 36 are in position to raise the needles to maximum height.

MODIFICATIONS OF THE INVENTION

Several modifications to the preferred embodiment should be considered within the spirit of the invention. First, it should be appreciated that while, in the preferred embodiment, the drive means for the feed tubes consists of interengaging pinions and an internal ring gear, other drive means known to those skilled in the art should be considered. Thus, it is possible to substitute friction drive means rather than engaging gear teeth in order to provide for rotation of the feed tubes. Such friction drive means could take the form of a single circular friction element driving a plurality of smaller friction elements each associated with a feed tube.

While an internal ring gear is shown in the preferred embodiment it should be appreciated that the pinions associated with each of the feed tubes could be driven by a central spur gear operating each of the pinions as a satellite gear.

As another possible modification attention should be given to the fact that while in the preferred embodiment the feed tube drive means are directly mechanically interconnected into the cam ring 34 associated with the latch needle operating cams 36, 38 it is possible to provide for separate and independent rotation of the annular cam ring 34 associated with the slotted needle cylinder assembly and the feed tubes associated with the yarn feed mechanism. That is to say, so long as the rotary motion of the feed tubes is synchronized with the lifting and lowering of the latch needles it is possible to provide for separate and independent actuation of these elements without the necessity of driving the feed tubes directly from the annular cam 34.

As an example of a still further modification it should be noted that the apertures 108 of the feed tubes provide an advantageous means of diverting the warp yarn from the center line of the feed tube thus creating the means by which the yarn may be captured by its associated needle. Within the spirit of this invention should be considered other structures for causing the warp yarn to emanate from the feed tube so as to be in a position away from the center line of the feed tube. Fingers or other elements may be employed in conjunction with the feed tube for this purpose.

What is claimed is:

1. A circular knitting machine for knitting a netting comprised of a plurality of circumferentially spaced warp wales incorporating an elastic weft yarn in a helical manner in the knit chain stitches of the individual warp wales, said machine comprising in combination:

a stationary slotted needle cylinder mounted on a base circumferentially spaced latch needles disposed in slots of said needle cylinder, each of said latch needles being provided with a latch having an open position and a closed position;

a rotatable annular cam ring defining needle operating cams;

rotary drive means to drive said annular cam ring in order to provide for reciprocating motion of said needles in said slots;

a stationary support plate axially aligned with and disposed above said needle cylinder;

a plurality of hollow rotatable elongated feed tubes supported by said support plate and associated with said needles, said feed tubes being adapted to receive individual warp yarns approximately concentric with the center line thereof;

each of said feed tubes being provided with at least one aperture extending substantially laterally therethrough near one end thereof, said feed tubes being adapted to feed individual warp yarns to said needles through said apertures;

a driving member disposed above said needle cylinder and adjacent said feed tubes, each of said feed tubes being provided with a driven member whereby rotation of said driving member produces rotation of said driven members and said feed tubes;

said driving member being interconnected to said rotatable cam ring such that rotation of said cam ring produces rotation of said driving member;

at least one bobbin of elastic weft yarn mounted on said driving member for feeding weft yarn across the warp yarns;

a plurality of latch wires carried by said annular cam ring and which cooperate with said latch needles in order to prevent premature closure thereof when the latch needles are in a raised position;

weft yarn feed control means for controlling the feed of elastic weft yarn to said needle cylinder, said weft yarn being incorporated, unknit, in the spaced chain stitches of the warp wale;

said weft yarn feed control means comprising a feed take-up wheel mounted on said driving member, means to rotate said take-up wheel defined by a drive mechanism associated with said annular cam ring, said drive mechanism being defined by an idler wheel adapted to rotate with said annular cam ring and power transmission means to transfer rotary motion from said idler wheel to said take-up wheel, said power transmission means comprising a sprocket associated with said idler wheel and a sprocket associated with said take-up wheel and a chain interconnecting said sprockets;

adjustment means provided at said idler wheel in order to vary the circumference of rotation of said idler wheel and the speed of said idler wheel;

the relationship of said rotary drive means to said feed tubes and said annular cam ring of said needle cylinder being such that said warp yarns are fed to said needles during each circular rotation of said feed tubes.

* * * * *